US010551863B2

(12) United States Patent
Hallikainen

(10) Patent No.: US 10,551,863 B2
(45) Date of Patent: Feb. 4, 2020

(54) VOLTAGE REGULATORS

(71) Applicant: Nordic Semiconductor ASA, Trondheim (NO)

(72) Inventor: Samuli Hallikainen, Trondheim (NO)

(73) Assignee: Nordic Semiconductor ASA, Trondheim (NO)

( * ) Notice: Subject to any disclaimer, the term of this patent is extended or adjusted under 35 U.S.C. 154(b) by 0 days.

(21) Appl. No.: 16/465,989

(22) PCT Filed: Dec. 1, 2017

(86) PCT No.: PCT/GB2017/053627
§ 371 (c)(1),
(2) Date: May 31, 2019

(87) PCT Pub. No.: WO2018/100389
PCT Pub. Date: Jun. 7, 2018

(65) Prior Publication Data

US 2019/0302824 A1 Oct. 3, 2019

(30) Foreign Application Priority Data

Dec. 2, 2016 (GB) ..... 1620542.9

(51) Int. Cl.
*G05F 3/26* (2006.01)

(52) U.S. Cl.
CPC ..... *G05F 3/262* (2013.01)

(58) Field of Classification Search
CPC ..... G05F 3/02; G05F 3/08; G05F 3/16; G05F 3/262; G05F 1/565; G05F 1/575
See application file for complete search history.

(56) References Cited

U.S. PATENT DOCUMENTS 6,204,653 B1 * 3/2001 Wouters ..... G05F 3/30 323/313
6,236,194 B1 5/2001 Manabe et al.
(Continued)

FOREIGN PATENT DOCUMENTS

EP 1361664 A1 11/2003
EP 1681760 A2 7/2006

OTHER PUBLICATIONS

International Search Report and Written Opinion for PCT/GB2017/053627, dated Mar. 6, 2018, 13 pages.
(Continued)

*Primary Examiner* — Adolf D Berhane
(74) *Attorney, Agent, or Firm* — Klarquist Sparkman, LLP

(57) ABSTRACT

A voltage regulation circuit (2) comprises first (4) and second (6) voltage regulators each arranged to receive an input voltage ($V_{in}$) and a respective reference voltage; and first (18) and second (30) reference voltage sources arranged to provide the first and second reference voltages respectively. In a first mode of operation, the first regulator varies the regulated output voltage in response to a difference between the regulated output voltage ($V_{out}$) and the first reference voltage. In a second mode of operation, the second regulator varies the regulated output voltage in response to a difference between the regulated output voltage and the second reference voltage. The second voltage regulator is arranged to provide a greater maximum output current than the first voltage regulator. The circuit further comprises a switch portion (8) arranged to provide a third mode of operation in which the first regulator provides the regulated output voltage and the second regulator provides additional output current.

26 Claims, 4 Drawing Sheets

(56) References Cited

U.S. PATENT DOCUMENTS

| | | | | |
|---|---|---|---|---|
| 9,190,988 | B1 | 11/2015 | Gupta | |
| 2008/0136472 | A1* | 6/2008 | Shor | H03F 3/345 327/156 |
| 2009/0108822 | A1 | 4/2009 | Hoshino et al. | |
| 2013/0027010 | A1* | 1/2013 | Groeneweg | G05F 1/575 323/280 |
| 2015/0189448 | A1 | 7/2015 | Siegumfeldt et al. | |
| 2016/0231761 | A1* | 8/2016 | Jain | G05F 1/565 |
| 2017/0205841 | A1* | 7/2017 | Jefremow | G05F 1/575 |
| 2018/0074532 | A1* | 3/2018 | Mandal | G05F 3/30 |
| 2018/0323780 | A1* | 11/2018 | Chen | H03K 17/22 |

OTHER PUBLICATIONS

Search Report under Section 17(5) for GB1620542.9, dated Jul. 19, 2017, 3 pages.

* cited by examiner

VOLTAGE REGULATORS

CROSS REFERENCE TO RELATED APPLICATIONS

This is the U.S. National Stage of International Application No. PCT/GB2017/053627 filed Dec. 1, 2017, which was published in English under PCT Article 21(2), which in turn claims the benefit of Great Britain Application No. 1620542.9, filed Dec. 2, 2016.

The present invention relates to electronic devices including multiple voltage regulators, particularly electronic devices arranged to use different voltage regulators under different operating conditions.

Modern battery powered system-on-chip (SoC) devices are typically arranged to be operated in different power modes. For example, the SoC may have a first, "normal" mode of operation in which a particular amount of current is used, but may also have a second, "low power" mode of operation to be used when there is no or little activity (e.g. processor tasks) being carried out by the SoC, the low power mode having a lower current consumption associated with it than the normal mode. The difference in current consumption between the normal and low power modes in some SoC devices can be as great as six orders of magnitude.

SoC devices require voltage regulators arranged to regulate an input voltage down to a lower, regulated voltage. For example, regulators may be arranged to receive an input voltage or "battery voltage" of 3.7 V from a lithium ion (Li-Ion) battery and produce a stable, regulated output voltage or "system voltage" of 1.8 V.

It is a common goal to minimise current consumption as much as possible in battery powered devices with a view to maintaining as high a battery life as possible. In order to reduce current consumption, a SoC may be provided with two or more voltage regulators that convert the battery voltage to the system voltage, where different voltage regulators are used in each mode of operation as required. For example, such an SoC may include an ultra-low power (ULP) low-dropout (LDO) voltage regulator arranged to provide currents less than 1 mA; and a high voltage LDO voltage regulator arranged to provide currents greater than 1 mA.

However, conventional devices having such an arrangement of voltage regulators are typically unable to switch between them rapidly due to the high power LDO voltage regulator requiring the initialisation of a bandgap reference circuit which provides the reference voltage necessary for the high power LDO voltage regulator to regulate its output.

Furthermore, the bandgap reference circuit which provides the reference voltage for the high power LDO voltage regulator is typically not initialised immediately upon powering up the device (i.e. at "start-up"). Thus at start-up only the ULP LDO is available for use until the bandgap reference circuit is ready, which takes some time. If the system load (i.e. the current drawn by the rest of the device) is higher than the output of the ULP LDO, the ULP LDO may be unable to "pull up" the system voltage at the output to the desired value.

When viewed from a first aspect, the present invention provides an electronic device comprising a voltage regulation circuit portion arranged to receive an input voltage and provide a regulated output voltage, the voltage regulation circuit portion comprising:

- a first voltage regulator arranged to receive the input voltage at a first regulation input and a first reference voltage at a first reference input, said first voltage regulator being arranged, in a first mode of operation, to vary the regulated output voltage in response to a difference between the regulated output voltage and the first reference voltage;
- a first reference voltage source arranged to provide said first reference voltage;
- a second voltage regulator arranged to receive the input voltage at a second regulation input and a second reference voltage at a second reference input, said second voltage regulator being arranged, in a second mode of operation, to vary the regulated output voltage in response to a difference between the regulated output voltage and the second reference voltage, said second voltage regulator being arranged to provide a greater maximum output current than said first voltage regulator;
- a second reference voltage source arranged to provide said second reference voltage;
- a switch portion arranged to connect the first reference voltage to the second reference input in a third mode of operation in which the first voltage regulator provides the regulated output voltage and the second voltage regulator provides additional output current.

Thus it will be appreciated by those skilled in the art that the present invention provides an electronic device arranged to operate in three different modes of operation: a first, low power mode of operation in which the first voltage regulator provides the regulated output voltage; a second, normal mode of operation in which the second voltage regulator provides the regulated output voltage; and a third, "slave" mode of operation in which the second voltage regulator "assists" the first voltage regulator in order to provide an extra "boost" of output current.

There are a number of different circuit topologies for generating reference voltages known in the art per se. However, in some embodiments the first reference voltage source comprises a bandgap reference circuit. In a set of potentially overlapping embodiments, the second reference voltage source comprises a bandgap reference circuit. Bandgap reference circuits are typically used for their temperature independence and relative indifference to variations in load or power supply.

Voltage regulators, like any control system, may be conditionally stable. As will be understood by those skilled in the art, the term "conditionally stable" when used in relation to control systems relates to those that are typically stable only within a certain range of gain values (where the "gain" is the ratio between the values of the output and input to the control system). The third mode of operation described hereinabove may not be stable from a control theory point of view due to operating the first voltage regulator at the increased level of output current, thus increasing the current gain of the first voltage regulator. In some embodiments therefore, the third mode of operation comprises a transitory mode that is activated in response to a transition in the output current to a value greater than the maximum output current of the first voltage regulator.

The device could be arranged to switch from the third mode of operation to the second mode of operation after a predetermined time. However, in a set of embodiments the device is arranged to generate a signal indicative of the second reference voltage source being initialised and to switch from the third mode of operation to the second mode of operation upon said signal being generated. In some such embodiments, the device comprises a reference voltage monitor circuit arranged to generate said signal indicative of the second reference voltage source being initialised. This reference voltage monitor circuit portion may be arranged to monitor the reference voltage generated by the second reference voltage source and determine that it is suitable for use by the second voltage regulator. This may, by way of non-limiting example only, comprise checking the voltage level of the second reference voltage, the stability of the voltage level, the rate of change of the voltage level, or any other suitable indicator of the quality of the second reference voltage.

In a set of embodiments, the second reference voltage source comprises:

- a bandgap circuit portion comprising first and second reference transistors and a current source arranged to drive the first reference transistor at a first current density and to drive the second reference transistor at a second, different current density, wherein the first reference transistor is connected to a first node and the second reference transistor is connected to a second node;
- an operational transconductance amplifier arranged to produce an output current that is proportional to a difference between a voltage at the first node and a voltage at the second node; and
- an output current mirror circuit portion arranged to generate a mirror current that is a scaled version of the output current and drive said mirror current through a load so as to produce the second reference voltage;
- wherein the reference voltage monitor circuit portion is arranged to monitor the operational transconductance amplifier and generate a flag if a current flowing through the operational transconductance amplifier exceeds a threshold.

The flag recited above can therefore advantageously be provided to the switch portion to switch to the second mode of operation.

In some embodiments, the operational transconductance amplifier (OTA) comprises first and second differential pair field-effect-transistors (FETs) arranged such that a gate terminal of the first differential pair field-effect-transistor is connected to the first node and a gate terminal of the second differential pair field-effect-transistor is connected to the second node. These first and second differential pair FETs form a differential pair, known in the art per se, that provides an output that depends on a difference between the voltages applied to the respective gate terminals of the first and second differential pair FETs.

In some embodiments, the operational transconductance amplifier comprises first and second current mirror load field-effect-transistors, arranged such that: a drain terminal of the first current mirror load field-effect-transistor is connected to a drain terminal of the first differential pair field-effect-transistor; a drain terminal of the second current mirror load field-effect-transistor is connected to a drain terminal of the second differential pair field-effect-transistor; and respective gate terminals of the first and second current mirror load field-effect-transistors are connected to the drain terminal of the first current mirror load field-effect-transistor. In a set of preferred embodiments, the first current mirror load field-effect-transistor is matched to the first replica current mirror field-effect-transistor.

In some embodiments, the reference monitoring circuit portion comprises a second current mirror and a replica field-effect-transistor having a gate terminal thereof connected to the first node, wherein the second current mirror is arranged to generate a replica current that is a scaled version of the output current and drive said replica current through a first reference resistor so as to generate a voltage at a monitor node between the second current mirror and the first reference resistor. In a set of preferred embodiments, the replica field-effect transistor is matched to the first differential pair field-effect-transistor.

It will be understood that the term "matched" as used herein with reference to two transistors means that they are substantially identical, subject to any typical manufacturing tolerances and variations. For example, two matched transistors should be made from the same materials (e.g. metals, semiconductors and doping levels) and have the same geometry (e.g. channel length and width), such that they exhibit substantially the same electrical characteristics as one another. By having the replica FET and the first differential FET matched in this manner, the replica current will be the same current flowing through the "branch" of the operational transconductance amplifier that includes the first differential FET.

In some embodiments, the second current mirror comprises first and second replica current mirror field-effect-transistors, arranged such that: respective gate terminals of the first and second replica current mirror field-effect-transistors are connected to a drain terminal of the first replica current mirror field-effect-transistor and to a drain terminal of the replica field-effect-transistor; and a drain terminal of the second replica current mirror field-effect-transistor is connected to the monitor node.

While the voltage at the monitor node may be used as the flag itself, in preferred embodiments the reference monitoring circuit portion comprises a single-input logic gate having an input terminal thereof connected to the monitor node, wherein the logic gate is arranged to produce a first logic value at an output thereof if the voltage at the monitor node is above a first threshold and to produce a second logic value at the output if the voltage at the monitor node is below a second threshold. Thus, in accordance with such embodiments, the logic gate may produce a digital signal (i.e. a binary '0' or '1') that depends on the value of the voltage at the monitor node.

In some embodiments, the logic gate comprises a Boolean inverter, wherein the first logic value is logic low and the second logic value is logic high. While such a Boolean may use a single threshold (i.e. the first and second thresholds are equal), in preferred embodiments a hysteresis arrangement is connected between the input and the output of the inverter and is arranged such that the first threshold is different to the second threshold. Such a hysteresis arrangement may, at least in some embodiments, comprise a second reference resistor and a switching arrangement, wherein said switching arrangement may selectively couple the first and second reference resistors. Thus it can be seen that the resistance connected to the monitor node can be varied between two different values in order to switch between the first and second threshold values.

Unlike the first reference voltage source which is typically always on when the device is powered up, the second reference voltage source may not be ready to provide the second reference voltage to the second voltage regulator immediately upon powering up the device and thus the second, higher power, voltage regulator takes longer to initialise than the first voltage regulator. In some embodiments, the device is arranged to operate in the third mode of operation upon powering up said device if the required output current exceeds the maximum output current of the first voltage regulator. In such embodiments, the device can start up in the third mode so as to provide the first voltage regulator with sufficient current to meet the output current requirements necessitated by the connected load. In some arrangements the device may then switch to the second mode of operation once the second voltage regulator is ready for use as described previously hereinabove.

It will be appreciated that the first reference voltage source is arranged to receive a supply voltage and produce the first reference voltage, which is sufficiently stable for use by the first voltage regulator. In some embodiments, the first reference voltage source is arranged to receive the input voltage and to generate the first reference voltage therefrom. Thus it will be appreciated that in accordance with such embodiments, the first reference voltage regulator is within the voltage domain associated with the input voltage.

Similarly, the second reference voltage source is arranged to receive a supply voltage and produce the second reference voltage, which is sufficiently stable for use by the second voltage regulator. The Applicant has recognised that it is typically more convenient for the second reference voltage source to be located in the 'system voltage' domain and thus in some embodiments, the second reference voltage source is arranged to receive the output voltage and to generate the second reference voltage therefrom. Thus it will be appreciated that in accordance with such embodiments, the second reference voltage regulator is within the voltage domain associated with the output voltage.

In some embodiments, the switch is arranged to mirror a replica current from the first voltage regulator to the second voltage regulator when operating in the third mode of operation. This replica current may be used as a reference by a current comparator or constant current source within the second voltage regulator that ensures that the second voltage regulator only sources current when the first voltage regulator is doing the same. Thus in the third mode, the second regulator may run in a constant current mode, enabling the regulated output voltage to be controlled by the first voltage regulator. In such operation, the constant current source receives a small replica current from the first voltage regulator and provides a larger, proportional current so as to allow the first voltage regulator to maintain the regulated output voltage at the desired value despite the increased load current requirements. When the circuit operates in the second mode, the constant current source typically does not affect voltage regulation unless the output current exceeds a particular threshold, at which point the constant current source may act to limit the output current.

In some embodiments, the device comprises a load current monitor circuit portion arranged to monitor the output current and selectively enable the first mode of operation if the output current is less than a first threshold value. This first threshold value may be the maximum output current of the first voltage regulator which, by way of non-limiting example only, may be 1 mA. In a set of potentially overlapping embodiments, a load current monitor circuit portion is arranged to monitor the output current and selectively enable the second mode of operation if the output current is greater than a second threshold value. This load current monitor can determine whether a large load current is required from the voltage regulating circuit portion and determine that the device should switch to the second mode of operation. Of course, if the load current is greater than the second threshold value but the second voltage regulator is not yet ready for use, the device may operate in the third mode of operation until the second voltage regulator is ready as described hereinabove.

In some embodiments, the first and second threshold values are the same, however in other embodiments the first and second threshold values are different.

Using different first and second threshold values provides the device with a degree of hysteresis such that the voltage regulating circuit portion does not rapidly fluctuate between the first and second modes at a particular current.

An embodiment of the invention will now be described, by way of example only, with reference to the accompanying drawings in which.

Figure 1:
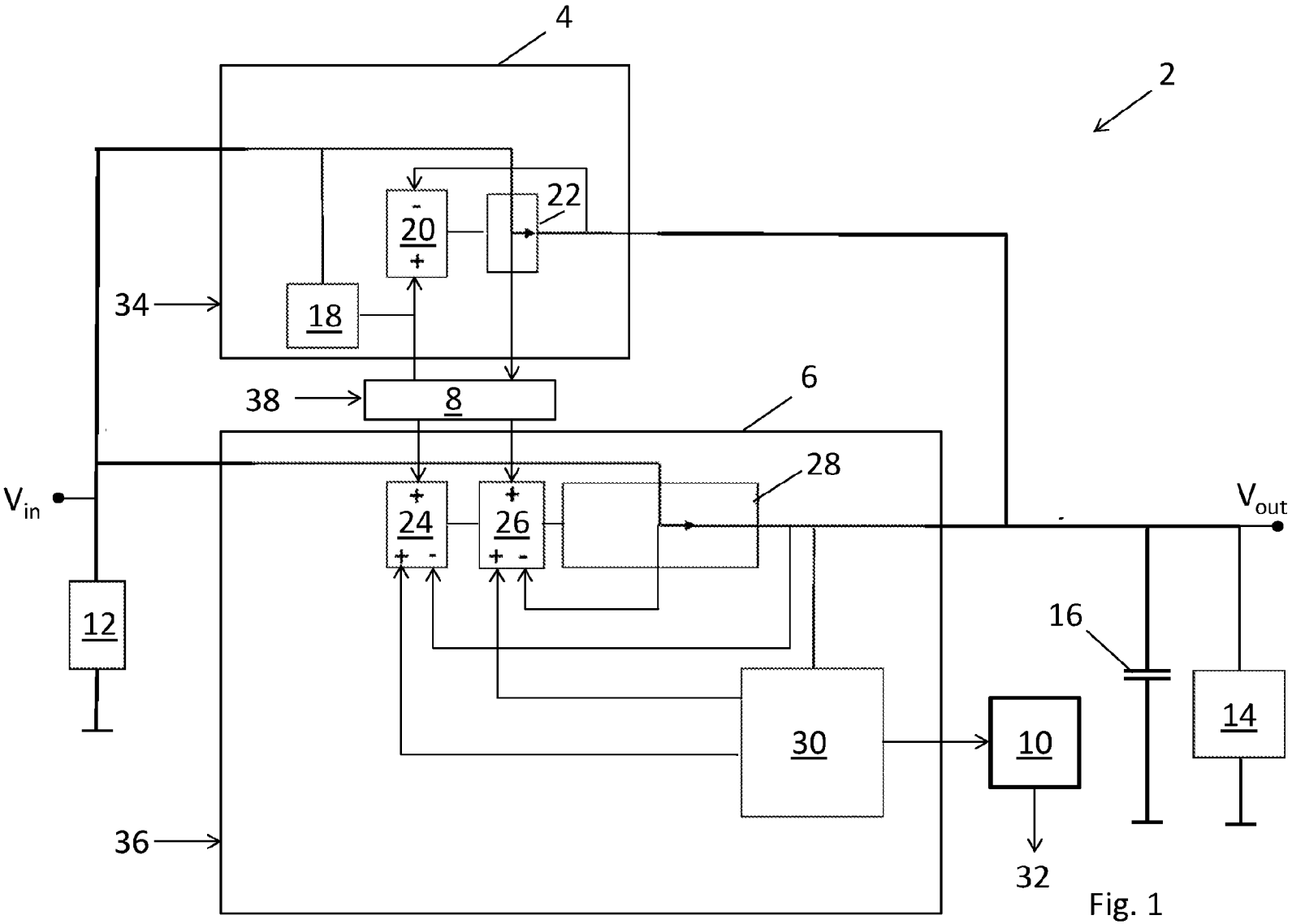
FIG. 1 shows schematically a voltage regulation circuit in accordance with an embodiment of the present invention.

FIG. 1 shows a voltage regulation circuit 2 in accordance with an embodiment of the present invention. The voltage regulation circuit 2 comprises: an ultra-low power (ULP) low-dropout (LDO) voltage regulator 4; a high power LDO voltage regulator 6; a switch 8; and a bandgap reference monitor circuit 10. The voltage regulation circuit 2 is arranged to receive an input voltage $V_{in}$ produced by a battery 12 and produce a regulated output voltage $V_{out}$, across which a load 14 and an output capacitance 16 are connected. In one example, the input voltage $V_{in}$ produced by the battery 12 is 3.7 V and the voltage regulation circuit 2 is arranged to produce a regulated output voltage $V_{out}$ of 1.8 V suitable for use by further circuitry within the device (not shown).

The ULP LDO 4 comprises: a bandgap reference circuit 18; a constant voltage source 20; and a pass-FET 22. The bandgap reference circuit 18 is arranged to receive the input voltage $V_{in}$ produced by the battery 12 and produce a stable reference voltage which is connected to the positive input terminal of the constant voltage source 20. The bandgap reference circuit 18 produces a temperature independent reference voltage that is relatively stable despite fluctuations in the power supply (e.g. fluctuations in $V_{in}$) as known in the art per se. The constant voltage source 20 is arranged to compare the output voltage $V_{out}$ to the reference voltage produced by the bandgap reference circuit 18 and apply a voltage proportional to the difference between these to the gate terminal of the pass-FET 22. This will vary the conductance of the pass-FET 22 and thus vary the current that flows through the ULP LDO 4 so as to regulate the value of the output voltage $V_{out}$ as required.

The bandgap reference circuit 18 used by the ULP LDO 4 is always-on but has very low power consumption requirements. However, the low power consumption of the bandgap reference circuit 18 results in a trade-off in accuracy and driving power, such that it is unable to provide its reference voltage under high load currents (i.e. it is unsuitable for use in the second mode of operation described below).

The high power LDO 6 comprises: a constant voltage source 24; a constant current source 26; a pass-FET 28; and a bandgap reference circuit 30. The constant voltage source 24 and pass-FET 28 of the high power LDO 6 operate in a similar manner to that described previously with reference to the ULP LDO 4. However, the high power LDO 6 uses the constant current source 26 to provide a bias current to the pass-FET 28.

It will be appreciated that the bandgap reference circuit 30 used by the high power LDO 6 is driven by the output voltage $V_{out}$ rather than by the input voltage $V_{in}$ as is the case with the bandgap reference circuit 18 of the ULP LDO 4. Thus, the bandgap reference circuit 30 is located within the 'system' domain whereas the bandgap reference circuit 18 used by the ULP LDO 4 is located within the 'battery' domain. As will be described in further detail below, this means that the bandgap reference circuit 30 used by the high power LDO 6 is not ready for use immediately upon start-up of the device and must instead wait until the output voltage $V_{out}$ has been initialised. As such, the output of the bandgap reference circuit 30 is connected to the reference monitoring circuit 10 which produces a signal 32 indicative of whether or not this bandgap reference circuit 30 is ready for use via the high power LDO 6.

The switch 8 is arranged such that the ULP LDO 4 and the high power LDO 6 may be bridged together if required. The operation of this switch 8 and the rest of the voltage regulation circuit 2 will be described further with reference to FIGS. 2 and 3 below.

The voltage regulation circuit 2 is arranged to be operable in three different modes. A first, low power mode utilises the ULP LDO 4 in order to regulate the output voltage $V_{out}$ and is enabled using a first mode input signal 34 which is provided to the ULP LDO 4. A second, high power mode of operation is enabled using a second mode input signal 36 provided to the high power LDO 6. In this second mode of operation, the high power LDO 6 regulates the output voltage $V_{out}$ rather than the ULP LDO 4. The high power LDO 6 is able to regulate the output voltage $V_{out}$ at much greater load currents than the ULP LDO 4.

Typically, in the second mode of operation the constant voltage source 24 regulates the output voltage Vout and the constant current source 26 does not affect regulation. However, if the load current $I_{load}$ becomes excessive, the constant current source 26 may override the constant voltage source 24 so as to limit the load current $I_{load}$.

The voltage regulation circuit 2 may also be operated in a third, transitory or start-up mode enabled by the third mode input signal 38 which is provided to the switch 8. This third mode of operation is to be used when there is a sudden increase in the load current beyond the capabilities of the ULP LDO 4 that occurs too suddenly for the high power LDO 6 to respond if the voltage regulation circuit 2 were to be switched into the second mode of operation directly from the first mode of operation, or if a high current is required on start-up of the device.

When the third mode of operation is enabled via the third mode input signal 38, the switch 8 acts so as to connect the bandgap reference circuit 18 of the ULP LDO 4 to the high power LDO 6. More specifically, the switch enables the constant voltage source 24 of the high power LDO 6 to compare the output voltage $V_{out}$ to the reference voltage produced by the bandgap reference 18 within the ULP LDO 4 rather than to a reference voltage provided by its own bandgap reference circuit 30.

The switch 8 also passes a replica current to the constant current source 26 within the high power LDO 6, which prevents the output voltage $V_{out}$ from being overdriven. The replica current is a small fraction (e.g. 1/500) of the current being passed by the ULP LDO pass-FET 22. This is advantageous where the bandgap circuit 18 of the ULP LDO 4 produces a higher reference voltage than the bandgap reference circuit 30 of the high power LDO 6. For example, the bandgap reference circuit 18 of the ULP LDO 4 may be arranged to provide a reference voltage of 1.2 V while the bandgap reference circuit 30 within the high power LDO 6 may be arranged to provide a relatively lower reference voltage of 0.9 V. In the third mode, the constant current source 26 receives the relatively small replica current and produces a larger, proportional current which augments the current driving capabilities of the ULP LDO 4.

Using the switch 8 in the third mode of operation to connect the voltage produced by the bandgap reference circuit 18 to the constant voltage source 24 of the high power LDO 6, the constant voltage source 24 may attempt to drive the output voltage $V_{out}$ to a higher reference value than it normally would in the second mode of operation. However, the constant current loop including the constant current source 26 will allow the high power LDO voltage regulator 6 to source current only when the ULP LDO 4 is actively sourcing current to the system and so sourcing the replica current to the constant current source 26. The output voltage $V_{out}$ remains defined by the voltage control loop of the ULP LDO 4.

Typical operation of the voltage regulation circuit 2 of FIG. 1 will now be described with reference to FIGS. 2 and 3.

Figure 2:
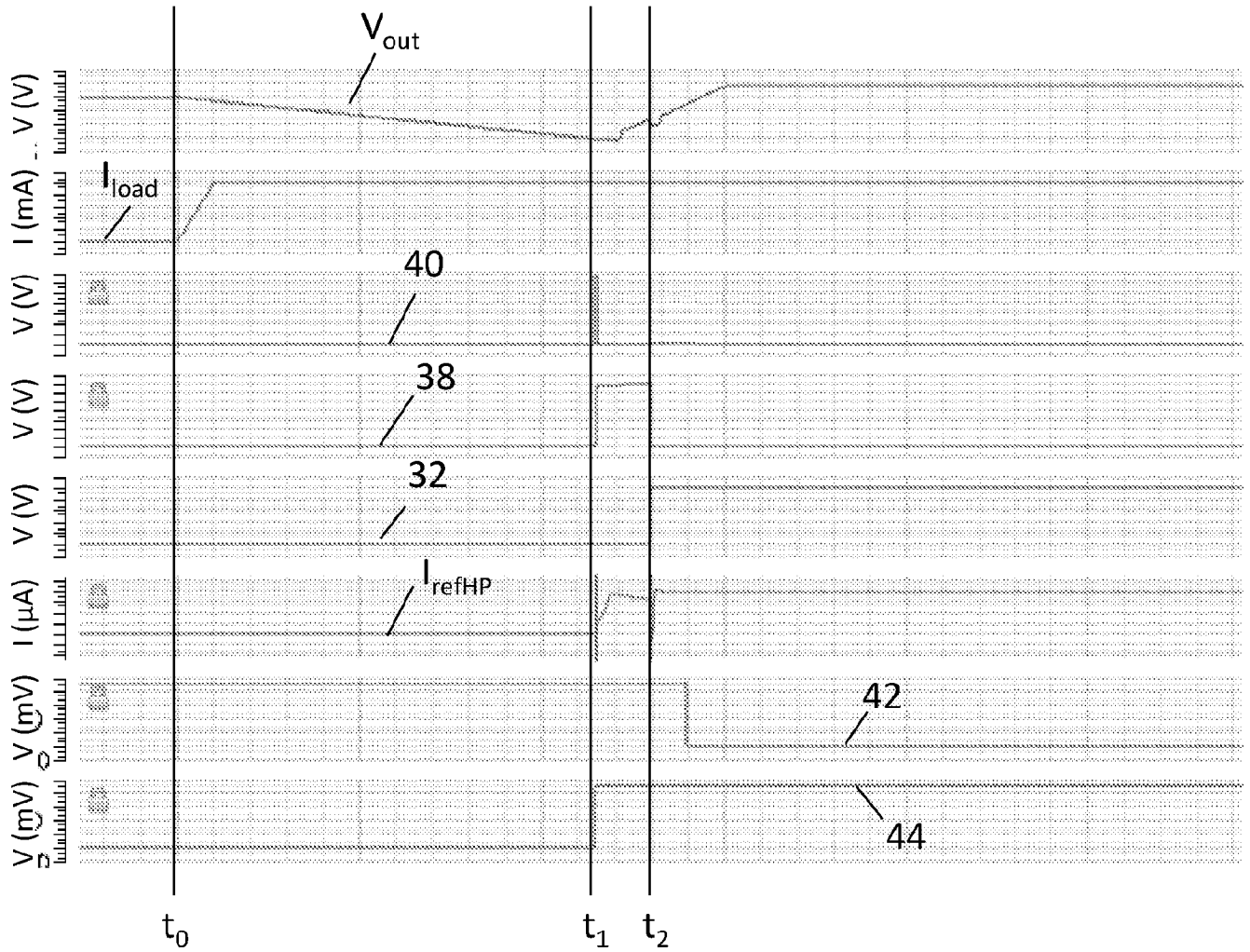
FIG. 2 shows simulation waveforms typical of the circuit of FIG. 1 when switched from a low power mode to a high power mode.

FIG. 2 shows simulation waveforms typical of the voltage regulation circuit 2 of FIG. 1 when switched from the first, low power mode to the second, high power mode. Initially the load current $I_{load}$ is relatively low and thus the voltage regulation circuit 2 operates in the low power mode (i.e. the first mode input signal 34 is set to logic high thus enabling the ULP LDO 4). At this time, the second and third mode input signals 36, 38 are held at logic low.

At time $t_0$, the load current $I_{load}$ experiences a sudden increase from the previously low value to a higher value that exceeds the maximum rated current of the ULP LDO 4 which, at time $t_0$, is the only regulator that is enabled (as denoted by the logic high value of the ULP enable signal 42). When this happens, the output voltage $V_{out}$ begins to decrease as the ULP LDO 4 struggles to maintain the output voltage $V_{out}$ in light of the increased load current requirements. This triggers a rising edge in an "overcurrent" signal 40 that indicates when the current is too large for the ULP LDO 4, and this rising edge is used to trigger the change in mode of operation.

At a subsequent time $t_1$, the output voltage $V_{out}$ has dropped sufficiently low so as to cause the third mode input signal 38 to transition from its former logic low state to logic high thus enabling the third mode of operation of the voltage regulation circuit 2. A high power enable signal 44 also transitions from a logic low state to a logic high state at this time $t_1$ and this signal 44 is used to instruct the high power LDO 6 and the bandgap reference circuit 30 to begin powering up. As discussed previously, this causes the switch 8 to connect the bandgap reference circuit 18 within the ULP LDO 4 to the positive input of the constant voltage source 24 within the high power LDO 6 and to pass the replica current from the ULP LDO 4 to the constant current source 26. The additional reference current $I_{refHP}$ provided to the high power LDO 6 during this third "slave" mode is denoted in FIG. 2.

A short duration later at time $t_2$, the bandgap reference circuit 30 within the high power LDO voltage regulator 6 is deemed ready via the monitoring circuit 10 and thus the signal 32 produced by the monitoring circuit 10 is set to logic high. This indicates to the voltage regulation circuit 2 that the high power LDO voltage regulator 6 may now operate alone using the bandgap reference circuit 30 to provide the references to the constant voltage source 24 and the constant current source 26. As such the second mode input signal 36 is set to logic high while the first and third mode input signals 34, 38 are set to logic low, thus disabling the ULP LDO 4 and the switch 8. Furthermore, the reference current $I_{refHP}$ provided to the high power LDO 6 remains at the constant value required for proper operation of the high power LDO 6 in the second mode of operation. Shortly after the successful transition to the second mode of operation, the ULP enable signal 42 drops to a logic low value, disabling the ULP LDO 4.

Figure 3:
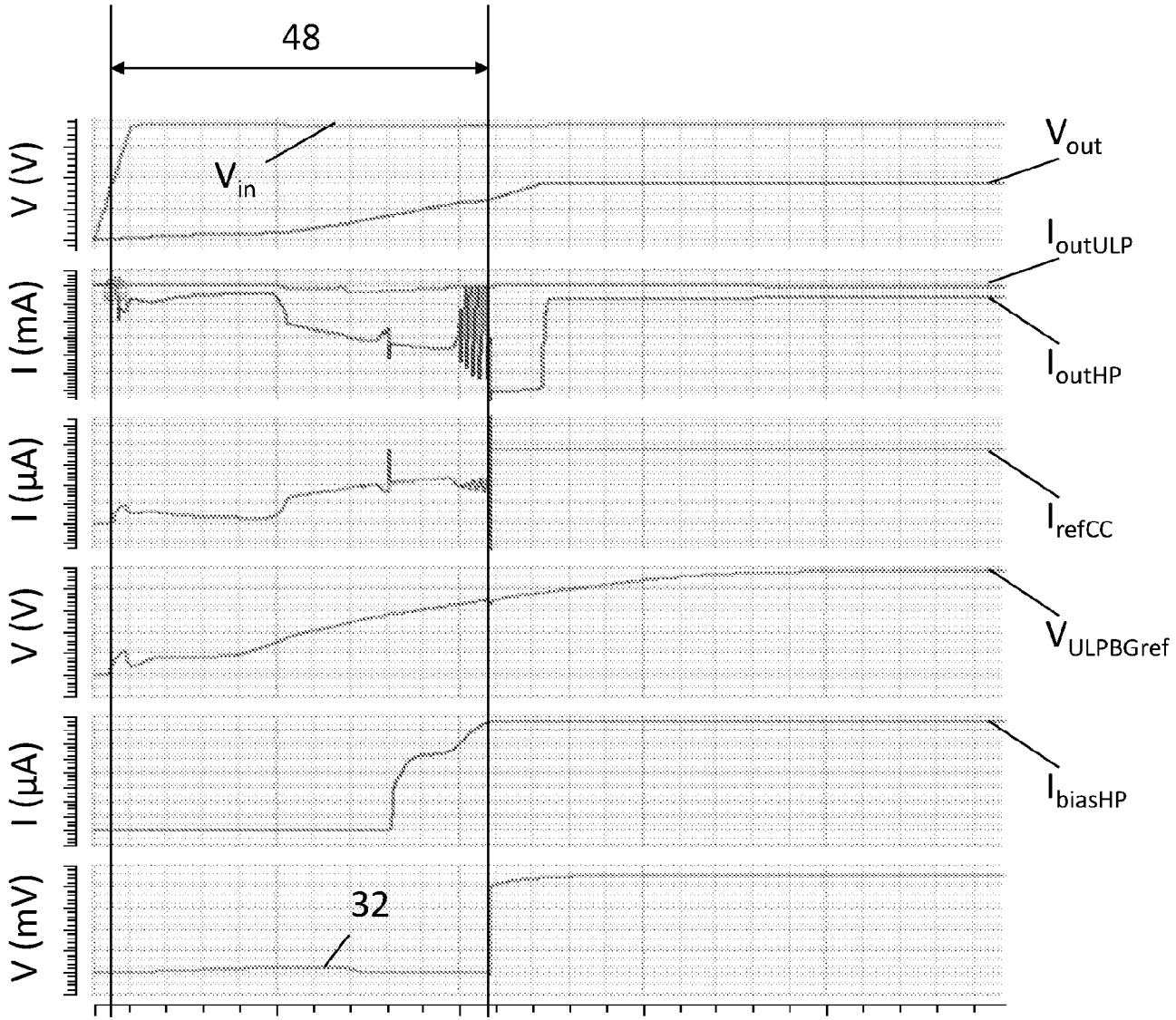
FIG. 3 shows simulation waveforms typical of the circuit of FIG. 1 during start-up.

FIG. 3 shows simulation waveforms typical of the voltage regulation circuit 2 of FIG. 1 during a start-up operation. When powered on, the input voltage $V_{in}$ provided by the battery 12 suddenly rises to the voltage of the battery 12 (i.e. 3.7 V). At this time the output voltage $V_{out}$ has not yet reached the regulated value and thus for an initial time window 48, the output voltage $V_{out}$ is too low for the bandgap reference circuit 30 to operate. In this instance the load current $I_{load}$ exceeds the current driving capabilities of the ULP LDO 4 and thus the voltage regulation circuit 2 enters the third mode of operation as described previously with reference to FIGS. 1 and 2.

During this time window 48 in which the voltage regulation circuit 2 operates in the third mode, the output current $I_{outULP}$ produced by the ULP LDO 4 is substantially constant at its maximum value, while the output current $I_{outHP}$ produced by the high power LDO 6 fluctuates in order to meet the current demands necessitated by the load. As described previously, this is achieved by the ULP LDO 4 passing a reference current $I_{ref}$ to the constant current source 26. At the end of the time window 48, the bandgap reference circuit 30 is initialised and the bias current $I_{blastHP}$ provided to the high power LDO 6 reaches a target value (e.g. 4 μA). The high power LDO 6 is then deemed ready via the monitoring circuit 10 and thus the signal 32 produced by the monitoring circuit 10 is set to logic high.

Thus it will be seen that by entering the third, "slave" mode of operation, the high power LDO 6 is able to assist the ULP LDO 4 until the monitoring circuit 10 indicates via its output signal 32 that the bandgap reference circuit 30 is ready for use such that the high power LDO 6 can take over regulation of the output voltage $V_{out}$ alone.

Figure 4:
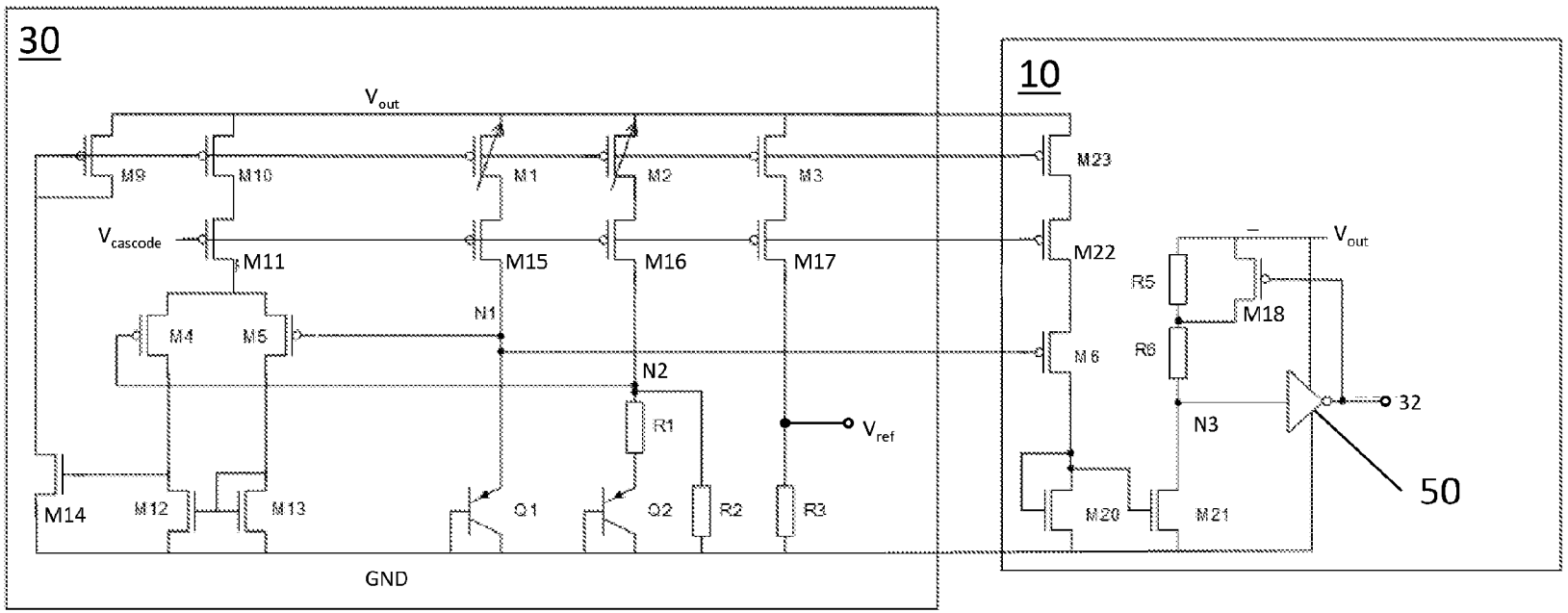
FIG. 4 is a circuit diagram of the bandgap reference circuit used within the circuit of FIG. 1 and a reference voltage monitoring circuit in accordance with an embodiment of the present invention.

FIG. 4 is a circuit diagram of the bandgap reference circuit 30 and a reference voltage monitoring circuit 10 in accordance with an embodiment of the present invention. As previously mentioned, the bandgap reference circuit 30 is arranged to provide a fixed reference voltage $V_{ref}$ that does not vary with temperature. The reference monitoring circuit 10 is arranged to monitor the bandgap reference circuit 30 and produce the signal 32 that indicates whether or not the bandgap reference circuit 30 is fully initialised.

The bandgap reference circuit 30 utilises two diode-connected bipolar junction transistors (BJTs) Q1, Q2 as reference transistors which are arranged in parallel. These two reference BJTs Q1, Q2 are arranged to be driven at different current densities as will be described in further detail below. The term "diode-connected" as used herein with reference to a BJT should be understood to mean that the base and collector terminals of the BJT are connected to one another. The emitter terminal of the first reference BJT Q1 is connected to a first node N1, while the emitter terminal of the second reference BJT Q2 is connected to a second node N2 via a fixed resistor R1.

The emitter area of the first reference transistor Q1 is greater than that of the second reference transistor Q1. This means that if the emitter current flowing through each transistor Q1, Q2 is the same, the current densities are different.

A further resistor R2 is connected in parallel with the second reference BJT Q2 and the fixed resistor R1 and provides temperature linearisation as explained below.

The bandgap reference circuit 30 further comprises an operational transconductance amplifier (OTA) constructed from a differential pair of p-channel metal-oxide-semiconductor field-effect-transistors (pMOSFETs) M4, M5, wherein the gate terminal of M4 is connected to the second node N2 and the gate terminal of M5 is connected to the first node N1. The respective source terminals of M4 and M5 are connected to $V_{out}$ via a tail mirror pMOSFET M10 and a cascade pMOSFET M11, the operation of both of which will be described in further detail below. The respective drain terminals of M4 and M5 are connected to a current mirror load which is constructed from two n-channel metal-oxide-semiconductor field-effect-transistors (nMOSFETs) M12, M13, arranged such that the drain terminal of the first current mirror load nMOSFET M13 is connected to the drain terminal of M5 and to the gate terminals of M12 and M13. The drain terminal of the other current mirror load MOSFET M12 is connected to the drain terminal of M4, while the source terminals of both M12 and M13 are connected to ground GND. The output of this differential amplifier is applied to the gate terminal of an output nMOSFET M14, which has its source terminal connected to ground GND and its drain terminal connected to the gate and drain terminals of a diode-connected pMOSFET M9.

This diode-connected pMOSFET M9 has its source terminal connected to the $V_{out}$ and forms a current mirror with a number of other pMOSFETs. Specifically, the gate and drain terminals of M9 are connected to the gate terminals of: the tail mirror pMOSFET M10; two variable pMOSFETs M1 and M2 arranged in series with the first and second reference BJTs Q1 and Q2 respectively; a load mirror pMOSFET M3 which is connected in series with a load resistance R3 as will be described below; and a monitoring mirror pMOSFET M23 situated within the reference monitoring circuit 50. Thus the current that flows through M9 (due to the conductance of the output nMOSFET M14 as dictated by the output of the differential amplifier) will be mirrored (i.e. copied) through M1, M2, M3, M10, and M23. Ideally at least some, and preferably all, of these transistors M1, M2, M3, M10, and M23 are matched to M9 and, by extension, to one another.

The bandgap reference circuit 30 further comprises a cascode circuit portion comprising: a first cascode pMOSFET M11 connected in series with the tail mirror pMOSFET M10 and the differential pair pMOSFETs M4 and M4; a second cascode pMOSFET M15 connected between M1 and Q1; a third cascode pMOSFET M16 connected between M2 and R1; a fourth cascode pMOSFET M17 connected between M3 and R3; and a fifth cascode pMOSFET M22 connected to the monitoring mirror pMOSFET M23. The gate terminals of each of these cascode transistors M11, M15, M16, M17, M22 are connected to a control voltage $V_{cascode}$ that controls the conductivity of the cascode circuit portion and sets the output impedance of the effective current sources (i.e. the tail-based current source provided to the differential pair transistors M4 and M5, the current sources provided to the reference transistors Q1 and Q2 by M1 and M2 respectively, the current source provided to the load R3 by M3, and the current source provided by M23 to the reference monitoring circuit portion 6), to a desired value. Similarly to the current mirror arrangement described above, it is advantageous if some, and preferably all, of these transistors M11, M15, M16, M17, and M22 are matched to one another.

The reference monitoring circuit 10 comprises the monitoring mirror pMOSFET M23 and the monitoring cascode pMOSFET M22 as described previously and further comprises: a replica pMOSFET M6; a replica current mirror constructed from two replica current mirror nMOSFETs M20 and M21; an inverter 50; fixed resistors R5 and R6; and a hysteresis pMOSFET M18. The reference monitoring circuit 10 is arranged such that the source terminal of M23 is connected to $V_{out}$; the source terminal of M22 is connected to the drain terminal of M23; the source terminal of M6 is connected to the drain terminal of M22; and the drain terminal of M20 is connected to the drain terminal of M6. Furthermore, the gate terminals of M20 and M21 are both connected to the respective drain terminals of M6 and M20. The drain terminal of M21 is connected to the input of the inverter 50 at a monitoring node N3 and to R6 which is further connected to $V_{out}$ via R5. R5 is arranged in parallel with the hysteresis pMOSFET M18 such that the source terminal of M18 is connected to $V_{out}$, the drain terminal of M18 is connected to a node between R5 and R6, and the gate terminal of M18 is connected to the output of the inverter 50.

The inverter 50 is arranged to perform a Boolean NOT operation on a signal provided at its input and provide a digital output signal 32 that is indicative of whether the bandgap reference circuit 30 is ready for use.

The operational transconductance amplifier is arranged to attempt to drive the voltage at the two nodes N1, N2 to the same value. Any difference in the voltages at the two nodes N1, N2 will cause a non-zero output voltage at the drain terminal of M12 which is applied to the gate terminal of M14. This causes M14 to conduct and thus a current flows from $V_{out}$ to ground GND through the diode-connected transistor M9. As the current through M9 is mirrored through M3, a current flows through the reference resistor R3 which gives rise to the reference voltage $V_{ref}$ across R3 in accordance with Ohm's law.

As a result of the current mirrors based on M1 and M2 respectively, the emitter currents through the reference transistors Q1, Q2 are the same. However as Q2 is larger, say N times larger, its base-emitter voltage $V_{BE2}$ will be lower than the base-emitter voltage of Q1, $V_{BE1}$ as shown in Eq. 1:

$$V_{BE2} = V_{BE1} - \frac{kT}{q} \cdot \ln(N) \quad \text{(Eq 1)}$$

where k/q is a constant and T is temperature.

The OTA comprising M4 and M5 ensures that nodes N1 and N2 are at the same voltage. Hence, the voltage across resistor R1 is equal to $V_{BE1}-V_{BE2}$, and the current through this resistor becomes:

$$I_{R1} = \frac{V_{BE1} - V_{BE2}}{R_1} = \frac{kT}{qR_1} \cdot \ln(N) \quad \text{(Eq 2)}$$

The current through resistor R2 can simply be expressed as:

$$I_{R2} = \frac{V_{BE1}}{R_2} \quad \text{(Eq 3)}$$

From this, the current through the pMOS transistor M2 is calculated as:

$$I_{M2} = I_{R2} + I_{R1} = \frac{V_{BE1}}{R_2} + \frac{kT}{qR_1} \cdot \ln(N) \quad \text{(Eq 4)}$$

This is also the current through M3, and hence the output voltage becomes:

$$V_{ref} = R_3 \cdot I_{M3} = \frac{R_3}{R_2} \cdot V_{BE1} + \frac{R_3}{R_1} \cdot \frac{kT}{q} \cdot \ln(N) \quad \text{(Eq 5)}$$

$V_{BE1}$ has a negative temperature coefficient, while kT/q has a positive temperature coefficient. By adjusting the ratio of R1 and R2 it is possible to achieve an overall temperature coefficient that is close to zero within the operating temperature range. The output voltage is then set to the desired level (0.9V) by adjusting R3.

The circuit shown thus provides reference currents that are relatively stable with temperature, whereas conventional bandgap circuits provide currents that are proportional to absolute temperature.

Furthermore, as the current through M9 is also mirrored through M23 (providing M5 is well matched with M6 and M13 is well matched with M20), the same current that flows through the "branch" of the operational transconductance amplifier comprising M10, M11, M5, and M13 will flow through the replica branch in the reference monitoring circuit 10 comprising M23, M22, M6, and M20. Furthermore as M20 forms a current mirror with M21, the current that flows through this replica branch will also flow through M21. Due to the fixed resistor R6 (and in some cases R5), this current provides a voltage at the monitoring node N3 which is connected to the input of the inverter 50.

If the voltage at this monitoring node N3 is sufficiently low, the inverter 50 will produce a logic high (i.e. a digital "one") at its output, and this digital signal is the flag 32 used to indicate whether or not the band gap reference circuit 30 is ready for use by external circuitry. When 32 is logic high, the hysteresis transistor M18 is effectively disabled due to the connection of its gate terminal to the output of the inverter 50. Under such circumstances, the voltage at the monitoring node N3 will be equal to the current flowing through M21 multiplied by the resistance of the series combination of R5 and R6 (any drain-source resistance of M21 is ignored here for simplicity).

If the voltage at the monitoring node N3 exceeds a particular threshold, the inverter 50 will produce a logic low (i.e. a digital "zero") flag 32. Due to the connection of the output of the inverter 50 to the gate terminal of the hysteresis transistor M18, this causes the hysteresis transistor M18 to conduct, effectively "short circuiting" R5. In this case, the voltage at the monitoring node N3 is then equal to the current flowing through M21 multiplied by the resistance of R6 only.

Thus the reference monitoring circuit 10 keeps the flag 32 at logic low until sufficient current flows through the OTA (i.e. through the branch comprising M5, M11, M10, and M13), which is indicative of the bandgap reference circuit 30 being ready for use. As the reference monitoring circuit 10 is "blind" to the headroom requirements of the OTA, sufficient current will only be flowing through the OTA when it is operating as required regardless of headroom requirements, which is an indirect indication that the bandgap reference circuit 30 may be relied on by the higher power regulator 6 and thus that the third 'slave' mode of operation is no longer needed and second, normal mode of operation can be used.

Thus it will be seen that the present invention provides a voltage regulation circuit that can use one voltage regulator in a slave mode so as to enhance the current output capabilities of another voltage regulator. Voltage regulation circuits in accordance with embodiments of the present invention provide for low current, high current, and transitory modes of operation. It will be appreciated by those skilled in the art that the embodiments described hereinabove are merely exemplary and are not limiting on the scope of the invention.

The invention claimed is:

1. An electronic device comprising a voltage regulation circuit portion arranged to receive an input voltage and provide a regulated output voltage, the voltage regulation circuit portion comprising:

a first voltage regulator arranged to receive the input voltage at a first regulation input and a first reference voltage at a first reference input, said first voltage regulator being arranged, in a first mode of operation, to vary the regulated output voltage in response to a difference between the regulated output voltage and the first reference voltage;

a first reference voltage source arranged to provide said first reference voltage;

a second voltage regulator arranged to receive the input voltage at a second regulation input and a second reference voltage at a second reference input, said second voltage regulator being arranged, in a second mode of operation, to vary the regulated output voltage in response to a difference between the regulated output voltage and the second reference voltage, said second voltage regulator being arranged to provide a greater maximum output current than said first voltage regulator;

a second reference voltage source arranged to provide said second reference voltage;

a switch portion arranged to connect the first reference voltage to the second reference input in a third mode of operation in which the first voltage regulator provides the regulated output voltage and the second voltage regulator provides additional output current.

2. The electronic device as claimed in claim 1, wherein the first reference voltage source comprises a bandgap reference circuit.

3. The electronic device as claimed in claim 1, wherein the second reference voltage source comprises a bandgap reference circuit.

4. The electronic device as claimed in claim 1, wherein the third mode of operation comprises a transitory mode that is activated in response to a transition in the output current to a value greater than the maximum output current of the first voltage regulator.

5. The electronic device as claimed in claim 1, arranged to generate a signal indicative of the second reference voltage source being initialised and to switch from the third mode of operation to the second mode of operation upon said signal being generated.

6. The electronic device as claimed in claim 5, further comprising a reference voltage monitor circuit arranged to generate said signal indicative of the second reference voltage source being initialised.

7. The electronic device as claimed in claim 1, wherein the second reference voltage source comprises:

a bandgap circuit portion comprising first and second reference transistors and a current source arranged to drive the first reference transistor at a first current density and to drive the second reference transistor at a second, different current density, wherein the first reference transistor is connected to a first node and the second reference transistor is connected to a second node;

an operational transconductance amplifier arranged to produce an output current that is proportional to a difference between a voltage at the first node and a voltage at the second node; and an output current mirror circuit portion arranged to generate a mirror current that is a scaled version of the output current and drive said mirror current through a load so as to produce the second reference voltage;

wherein the reference voltage monitor circuit portion is arranged to monitor the operational transconductance amplifier and generate a flag if a current flowing through the operational transconductance amplifier exceeds a threshold.

8. The electronic device as claimed in claim 7, wherein the operational transconductance amplifier comprises first and second differential pair field-effect-transistors arranged such that a gate terminal of the first differential pair field-effect-transistor is connected to the first node and a gate terminal of the second differential pair field-effect-transistor is connected to the second node.

9. The electronic device as claimed in claim 8, wherein the operational transconductance amplifier comprises first and second current mirror load field-effect-transistors, arranged such that:

a drain terminal of the first current mirror load field-effect-transistor is connected to a drain terminal of the first differential pair field-effect-transistor;

a drain terminal of the second current mirror load field-effect-transistor is connected to a drain terminal of the second differential pair field-effect-transistor; and respective gate terminals of the first and second current mirror load field-effect-transistors are connected to the drain terminal of the first current mirror load field-effect-transistor.

10. The electronic device as claimed in claim 9, wherein the first current mirror load field-effect-transistor is matched to the first replica current mirror field-effect-transistor.

11. The electronic device as claimed in claim 1, further comprising a second current mirror and a replica field-effect-transistor having a gate terminal thereof connected to the first node, and wherein the second current mirror is arranged to generate a replica current that is a scaled version of the output current and drive said replica current through a first reference resistor so as to generate a voltage at a monitor node between the second current mirror and the first reference resistor.

12. The electronic device as claimed in claim 11, wherein the second current mirror comprises first and second replica current mirror field-effect-transistors, arranged such that: respective gate terminals of the first and second replica current mirror field-effect-transistors are connected to a drain terminal of the first replica current mirror field-effect-transistor and to a drain terminal of the replica field-effect-transistor; and a drain terminal of the second replica current mirror field-effect-transistor is connected to the monitor node.

13. The electronic device as claimed in claim 11, wherein the reference voltage monitor circuit comprises a single-input logic gate having an input terminal thereof connected to the monitor node, wherein the logic gate is arranged to produce a first logic value at an output thereof if the voltage at the monitor node is above a first threshold and to produce a second logic value at the output if the voltage at the monitor node is below a second threshold.

14. The electronic device as claimed in claim 13, wherein the logic gate comprises a Boolean inverter, wherein the first logic value is logic low and the second logic value is logic high.

15. The electronic device as claimed in claim 14, comprising a hysteresis arrangement connected between the input and the output of the inverter and is arranged such that the first threshold is different to the second threshold.

16. The electronic device as claimed in claim 15, wherein the hysteresis arrangement comprises a second reference resistor and a switching arrangement, and wherein said switching arrangement selectively couples the first and second reference resistors.

17. The electronic device as claimed in claim 1, arranged to operate in the third mode of operation upon powering up said device if the required output current exceeds the maximum output current of the first voltage regulator.

18. The electronic device as claimed in claim 17, arranged to switch to the second mode of operation once the second voltage regulator is ready for use.

19. The electronic device as claimed in claim 1, wherein the first reference voltage source is arranged to receive the input voltage and to generate the first reference voltage therefrom.

20. The electronic device as claimed in claim 1, wherein the second reference voltage source is arranged to receive the output voltage and to generate the second reference voltage therefrom.

21. The electronic device as claimed in claim 1, wherein the switch portion is arranged to mirror a replica current from the first voltage regulator to the second voltage regulator when operating in the third mode of operation.

22. The electronic device as claimed in claim 1, further comprising a load current monitor circuit portion arranged to monitor the output current and selectively enable the first mode of operation if the output current is less than a first threshold value.

23. The electronic device as claimed in claim 1, further comprising a load current monitor circuit portion arranged to monitor the output current and selectively enable the second mode of operation if the output current is greater than a second threshold value.

24. The electronic device as claimed in claim 22, wherein the load current monitor circuit portion is further arranged to monitor the output current and selectively enable the second mode of operation if the output current is greater than a second threshold value.

25. The electronic device as claimed in claim 24, wherein the first and second threshold values are the same.

26. The electronic device as claimed in claim 24, wherein the first and second threshold values are different.

* * * * *